United States Patent [19]

Di Bernardo

[11] Patent Number: 4,879,863

[45] Date of Patent: Nov. 14, 1989

[54] APPARATUS FOR PACKAGING AN ARTICLE BY MEANS OF HEAT-SHRINKABLE FILM

[75] Inventor: Pietro Di Bernardo, Milan, Italy

[73] Assignee: Interdibipack S.p.A., Milan, Italy

[21] Appl. No.: 223,065

[22] Filed: Jul. 19, 1988

[30] Foreign Application Priority Data

Jul. 24, 1987 [IT] Italy ..... 21421 A/87

[51] Int. Cl.[4] ..... B65B 9/08; B65B 53/06; B65B 67/04

[52] U.S. Cl. ..... 53/557; 53/568; 53/390

[58] Field of Search ..... 53/390, 442, 555, 557, 53/568

[56] References Cited

U.S. PATENT DOCUMENTS

| | | | |
|---|---|---|---|
| 3,195,290 | 7/1965 | Thompson | 53/568 |
| 3,364,650 | 1/1968 | House | 53/568 |
| 3,496,700 | 2/1970 | McCabe | 53/568 |
| 4,104,848 | 8/1978 | Torre | 53/557 |
| 4,162,604 | 7/1979 | Bartolomei | 53/557 |
| 4,555,895 | 12/1985 | Torre | 53/557 |

*Primary Examiner*—John Sipos

*Attorney, Agent, or Firm*—Finnegan, Henderson, Farabow, Garrett & Dunner

[57] ABSTRACT

An apparatus for packaging an article by means of heat-shrinkable film comprises, in combination, first support means adapted to support a reel of the said film, a device for sealing the film wrapped around the article to be packaged, an air heating chamber, and second means for placing into and removing from the said chamber the article contained within the said film. The said chamber has a substantially box-shaped configuration and is self-bearing, and with respective walls thereof there are associated the said first support means, the said sealing device and the said second means of placement and removal.

4 Claims, 7 Drawing Sheets

Fig. 7
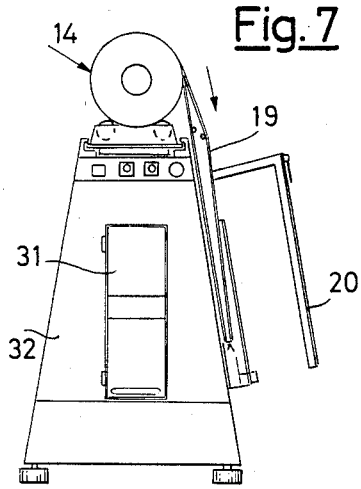
Fig. 8
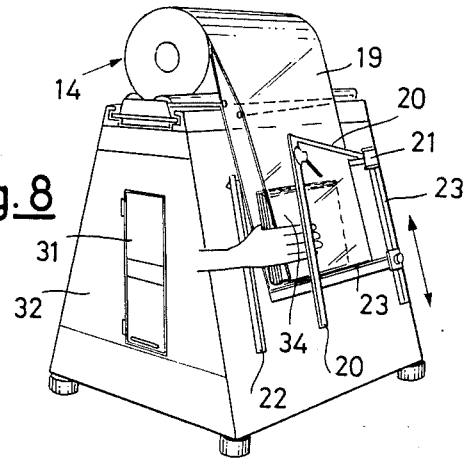
Fig. 9
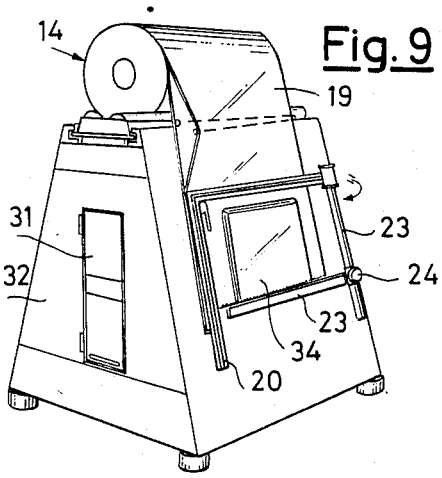
Fig. 10
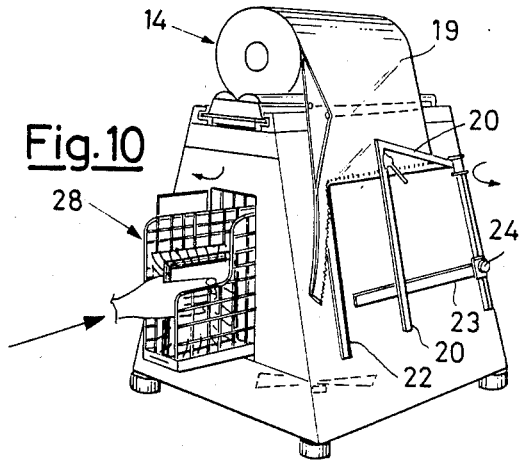
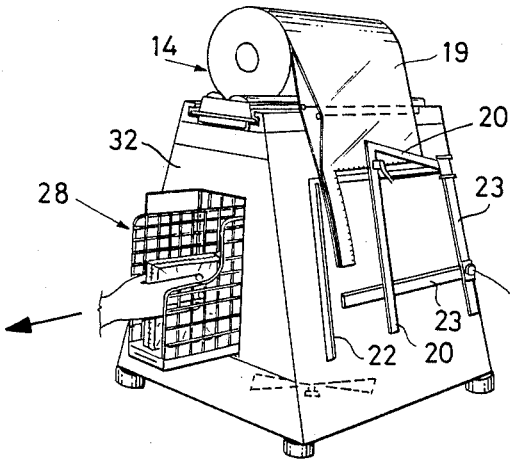
Fig. 11

APPARATUS FOR PACKAGING AN ARTICLE BY MEANS OF HEAT-SHRINKABLE FILM

BACKGROUND OF THE INVENTION

The present invention relates to an apparatus for the packaging and sealing of an article within heat-shrinkable film of the so-called "centerfolded" type.

The apparatus according to the invention is particularly, but not exclusively, adapted for packaging books, magazines, office files, table, correspondence and all other papers requiring to be stored, despatched or sealed, also for purposes of secrecy.

Different kinds of apparatus for packaging material inside heat-shrinkable film are known.

A first type of apparatus consists structurally of the combination of a film sealing device between the opposite faces of which the article to be packaged has been placed, and a tunnel in which the film is heat-shrunk onto the article.

The film sealing device (sealing rod type) and the tunnel are disposed in-line and the article is fed through the tunnel by means of a conveyor, generally a roller conveyor.

Packaging apparatus of such type normally have large bulk dimensions and are suitable for high outputs and for the packaging mostly of relatively large articles.

In another type of packaging apparatus the sealing rods of the sealing device are incorporated in a closure of a chamber in which the heat-shrinking of the film is also performed by means of forced hot air circulation.

Such kind of packaging apparatus is for example described in U.S. Pat. No. 4,104,848, from which the relevant technology may be better understood.

Although it can be relatively small in size and is very satisfactory in operation, a packaging apparatus embodied according to U.S. Pat. No. 4,104,848 can be used in a manner such as to achieve operating speeds that counsel its use in certain specific sectors.

If used to package a small number of articles per day, its potential is wasted, and in some cases it may prove unwieldy.

The object of the present invention is to embody a packaging machine that has a highly compact structure, is economical to construct, extremely dependable in use and that can find a justified use even for relatively low outputs.

SUMMARY OF THE INVENTION

To achieve the said object, the present invention embodies an apparatus for packaging an article by means of heat-shrinkable film, of the type comprising in combination: first support means adapted to support a reel of the said film, a device for sealing the film wrapped around the article to be packaged, an air heating chamber, and second means for placing the article contained within the said film into the said chamber and removing it therefrom, wherein the said chamber has a substantially box-shaped configuration and is self-bearing and wherein the said first support means, sealing device and second placement and removal means are associated with respective walls of said chamber.

The said second means preferably consists of a basket passing through a window formed in a wall of the said chamber and adapted to engage guide and support elements provided inside the said chamber, the said basket being positioned in a manner contiguous to heating means and, optionally, forced air circulation means.

BRIEF DESCRIPTION OF THE DRAWINGS

The functional and structural characteristics of the invention, and its advantages over the known art, will become more apparent from an examination of the following description, referred to the appended drawings which show an example of a packaging machine incorporating the innovative principles of the invention. In the drawings:

FIGS. 7 to 11 are diagrammatic views showing the manner of operation of the machine illustrated in the previous Figures.

DETAILED DESCRIPTION OF THE INVENTION

Figure 1:
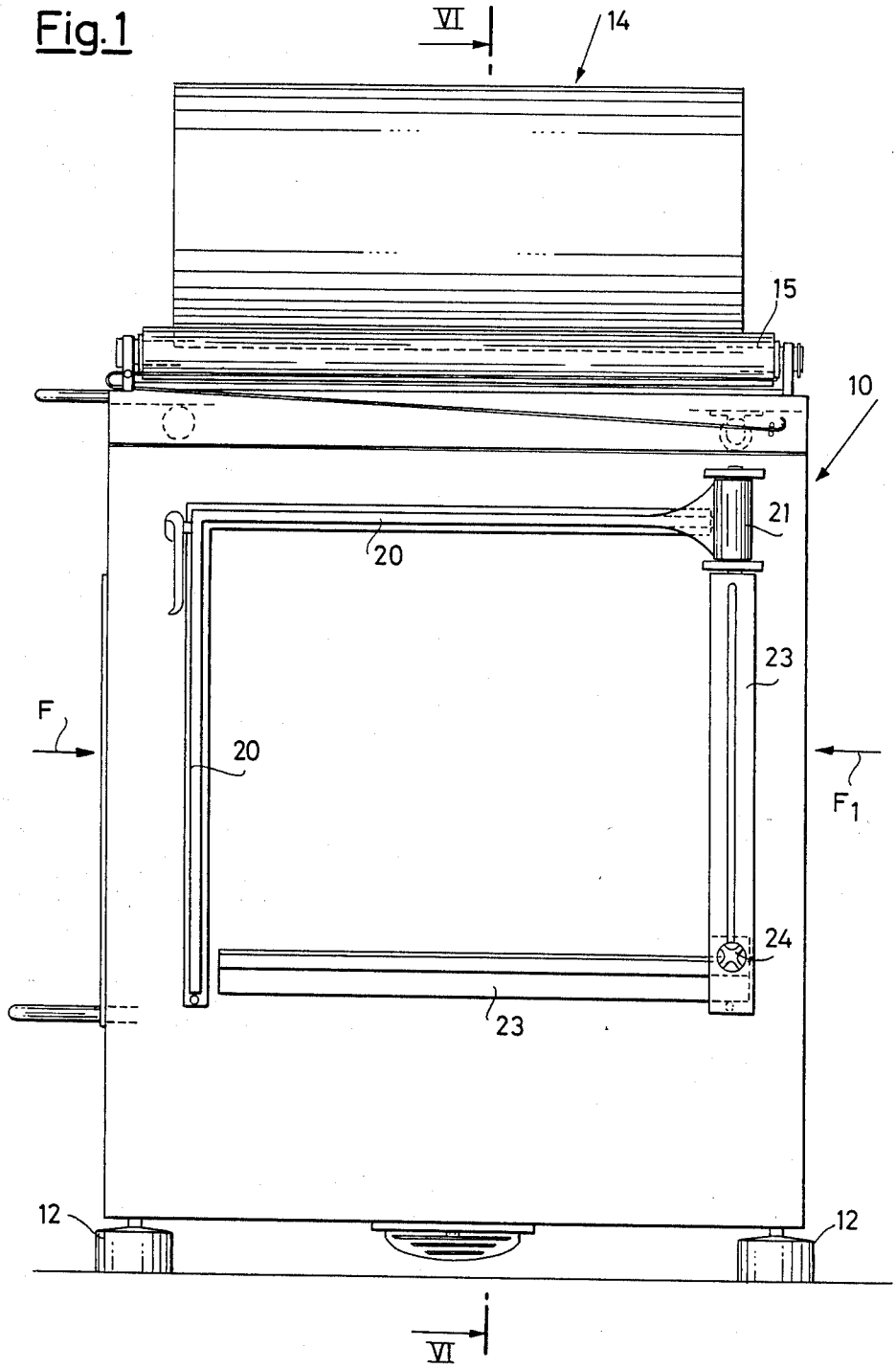
FIG. 1 is a lateral elevation showing the sealing area of the packaging machine in question.
Figure 2:
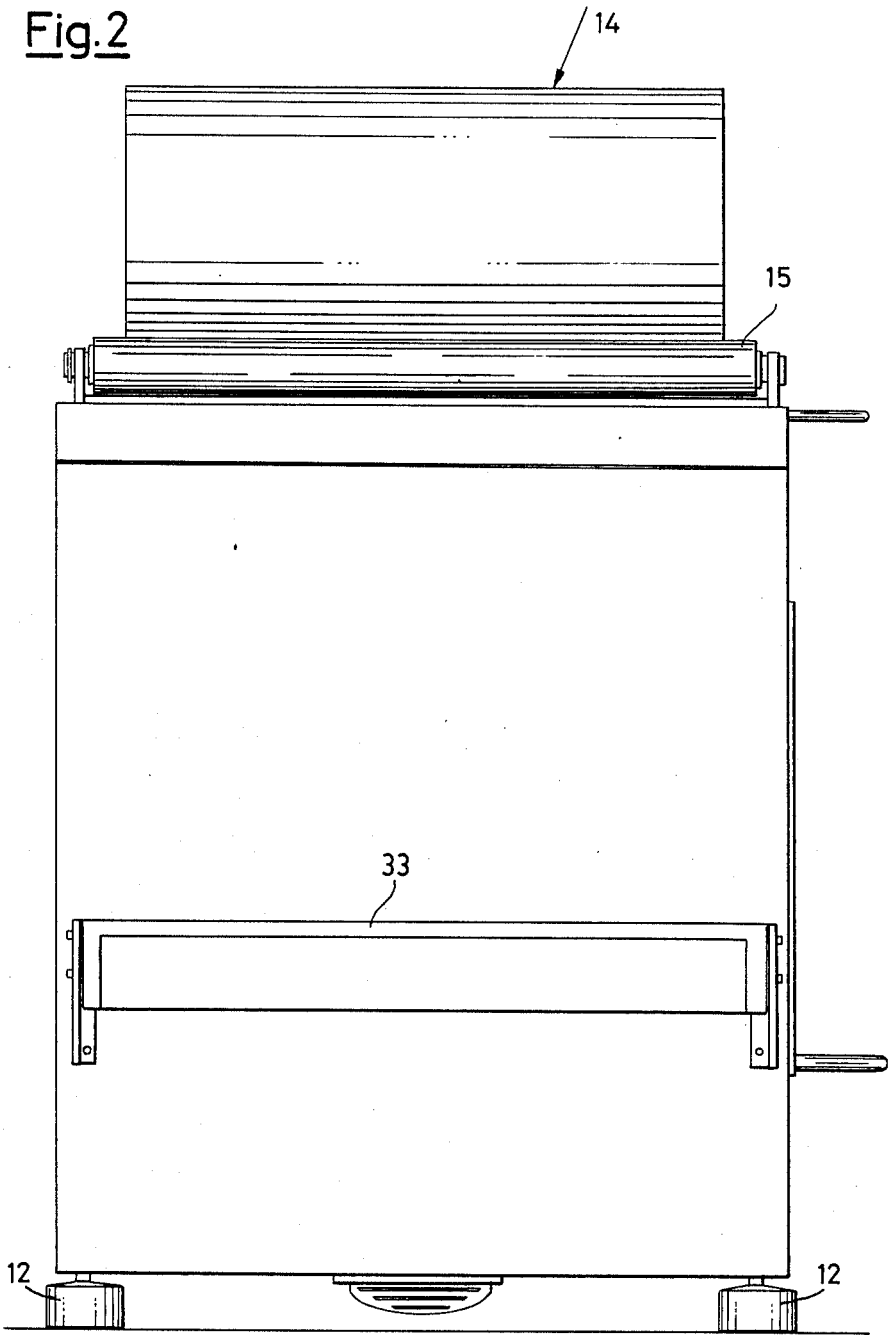
FIG. 2 is a lateral elevation showing the part of the machine opposite that shown in FIG. 1.
Figure 3:
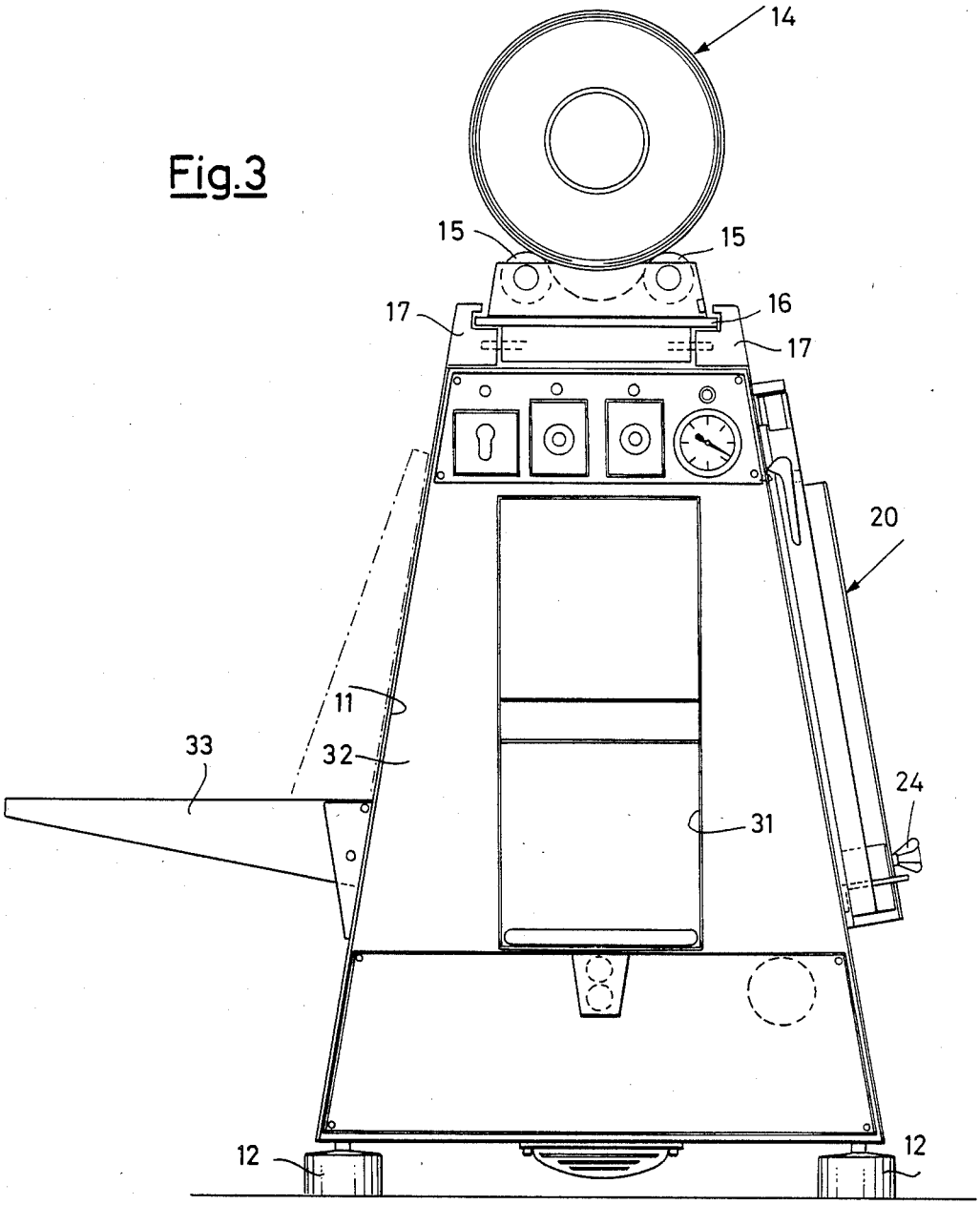
FIG. 3 is an elevational view taken in the direction of arrow F in FIG. 1.
Figure 4:
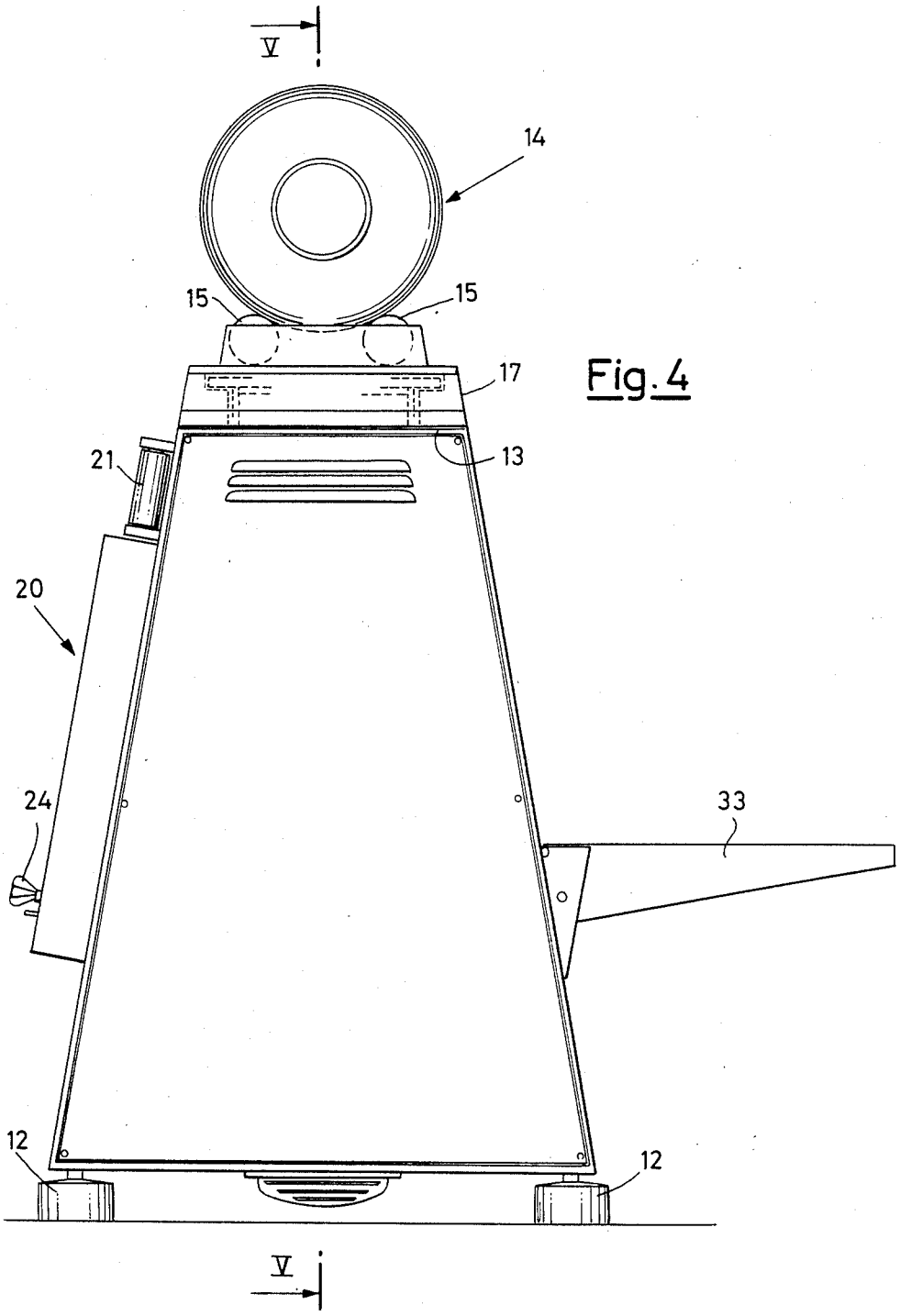
FIG. 4 is an elevational view taken in the direction of arrow $F_1$ of FIG. 1.
Figure 5:
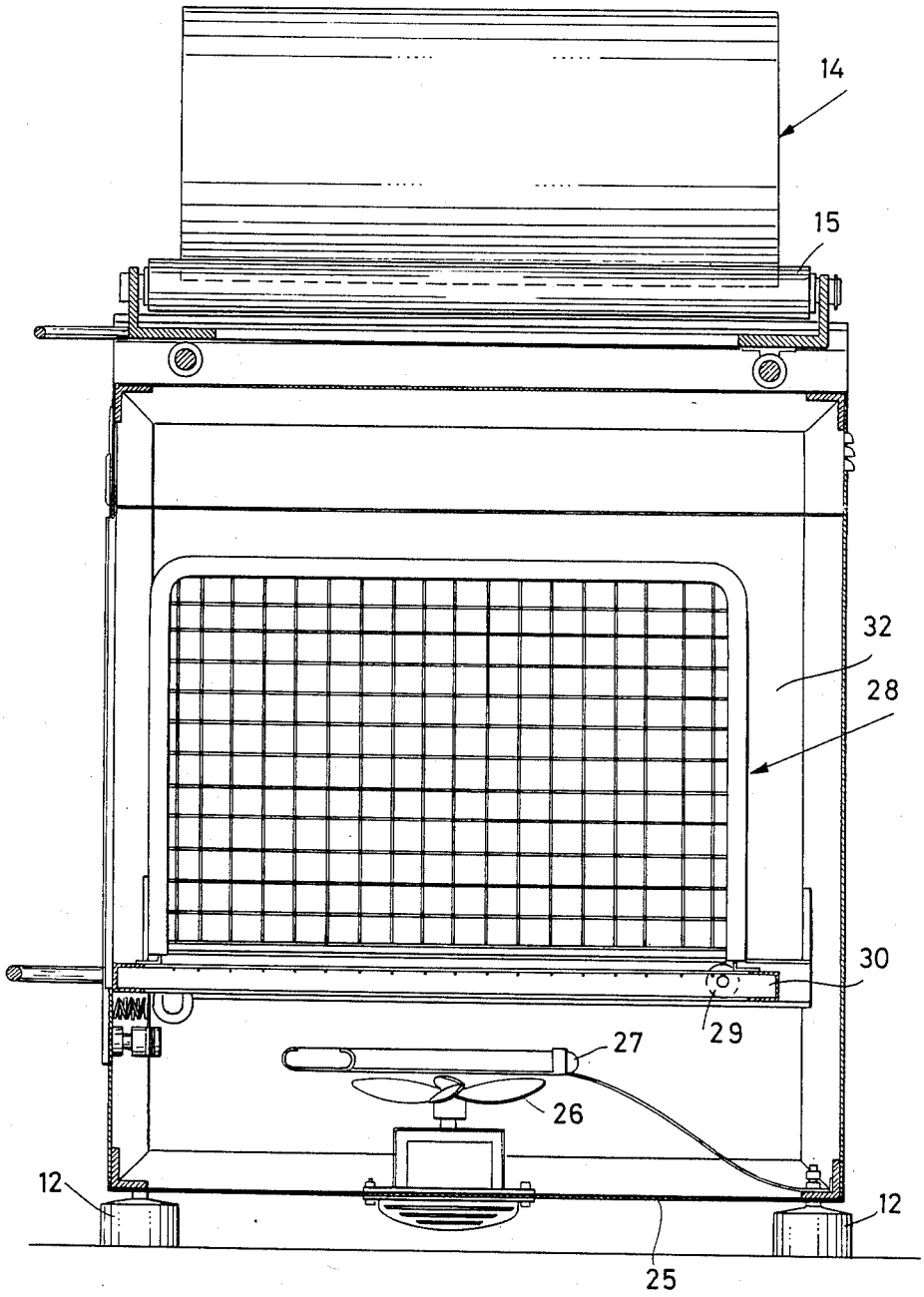
FIG. 5 is a longitudinal section taken on the line V—V of FIG. 4.
Figure 6:
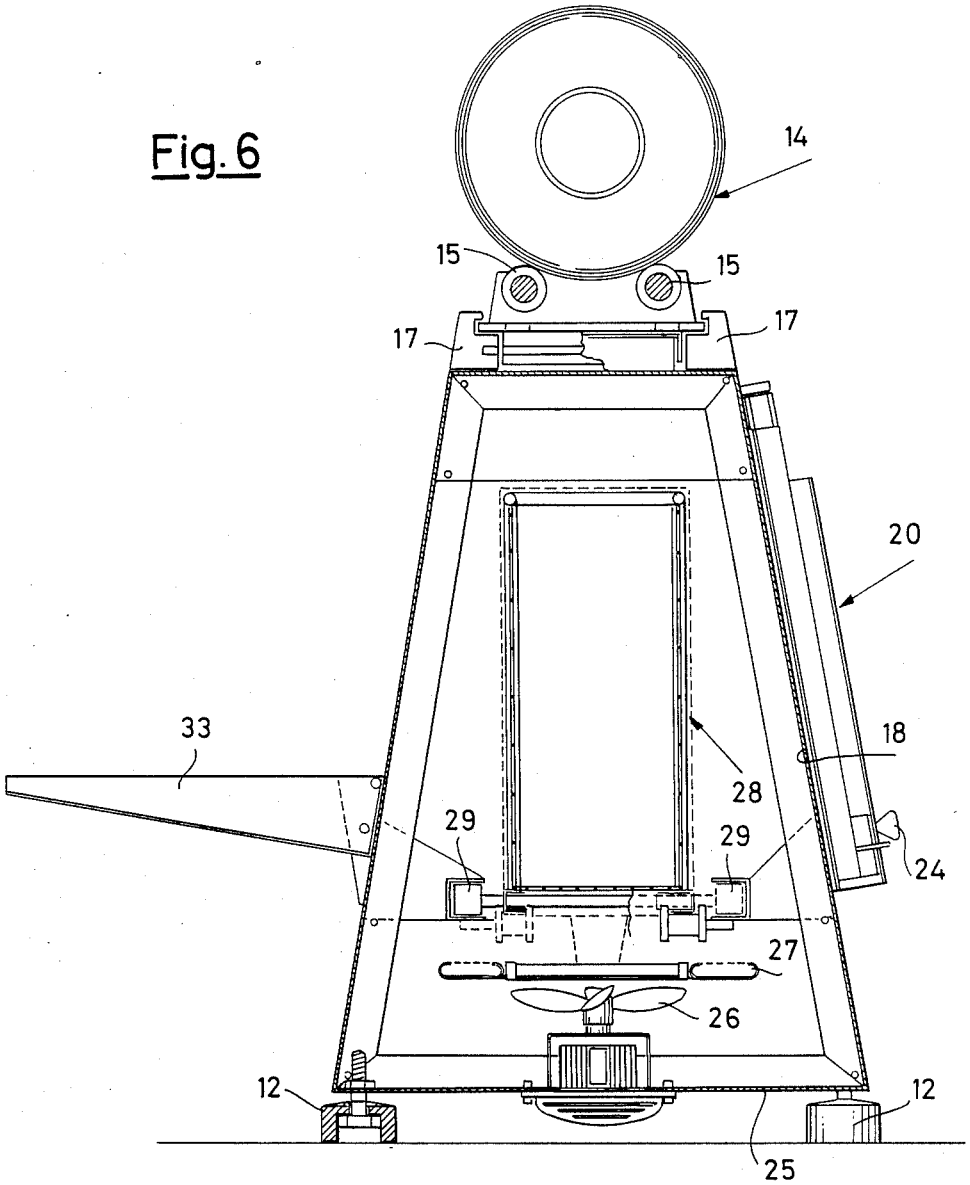
FIG. 6 is a section taken on the line VI—VI of FIG. 1.

With reference to the drawings, the machine of the invention is indicated overall by 10 and consists structurally of an air heating chamber 11 and, preferably but not necessarily, means for forced circulation of the heated air, such chamber being in the form of a box-shaped self-bearing housing which, in the example shown, is generally dihedral in shape and rests on adjustable feet 12.

The top wall 13 of the chamber 11 carries a means for supporting and feeding a reel 14 of plastic film 19 of the so-called "centerfolded" type. The said means can consist simply of a cradle formed by a pair of freely rotatable rollers 15 mounted on a slide 16 coupled to lateral guides 17. In this manner the slide 16 can be translated along the guides 17 to adjust the position of the reel 14 of film with respect to the sealing device hereinafter descriped, in relation to the dimensions of the article to be packaged.

On the outside of a vertical wall 18 of the chamber 11 is mounted a means for sealing the plastic film 19. The general structure of the sealing means is per se known, and comprises a pair of electrical sealing resistance bars 20, at right angles to one another and pivotally mounted at 21 to the wall 18.

Cooperating with the resistance bars 20 is a right angled backing plate 22. Further provided are a pair of bars 23 which are also disposed at right angles to each other with one being mounted vertically to the wall 18 and the other horizontally for adjustment with respect to the vertical bar by an adjustement screw 24. The bars 23 (the horizontal one of these having the form of a shelf to support the article) thus form a wrap-and-support section for the article to be packaged, which is placed between the faces of the film 19 and rests on the horizontal shelf-shaped bar 23 (FIG. 8). Within the chamber 11, on its bottom wall 25, there is mounted a heating means for forcing circulation of heated air in the chamber. As embodied, this means comprises a fan 26 which causes forced circulation of the air inside the chamber 11, which air is heated by an electrical resistance element 27 supported above the fan 26.

It is noteworthy that the disposition of the fan 26 and resistance 27 can be other than that shown. The fan 26 could for instance be mounted at the top of the chamber 11 with the resistance 27 below it. A disposition of the complex on one side of the chamber can also be contemplated.

A basket 28 for holding an article wrapped in a piece of film 19 is provided having wheels 29 that cooperate with guides 30 provided inside chamber 11 above the heating means.

The basket 28 can in this way be placed into and supported within the chamber 11, and removed therefrom, through an opening having a door 31 in chamber wall 32. (See FIGS. 9–11)

A service board 33 extends from the side of chamber 11, opposite the sealing means 20 for holding, for example, a supply of articles to be packaged.

The manner of operating of the packaging machine heretofore described will become apparent from FIGS. 7 to 11.

As is shown in FIG. 7, when the electrical sealing bars 20 are pivoted about 21 and raised (by the agency of a handle) with respect to the wall 18, a section of 2 ply of centerfolded film 19 is manually pulled into the sealing area between the rods 23. The article to be packaged, for example a book 34, is inserted between the two faces of the film 19 and rests on the horizontal support bar 23 (FIG. 8). The sealing bars 20 are then lowered, as shown in FIG. 9, against the backing plates 22, and in this way the two opposite surfaces of the film 19 are sealed together, the lower edge of the film having been sealed in the previous wrapping operation, and the resulting envelope separates from the rest of the film 19.

The envelope containing the book 34 is then removed from the sealing device and placed, either by itself or with other previously packaged books, inside the basket 28 which is inserted (FIG. 10) into the heat-shrinking chamber 11 through the opening covered by door 31.

At this point the fan 26/resistances 27 heating means is turned on, with the result that hot air is force-circulated within the chamber so as to cause the plastic film to heat-shrink around the article contained in it.

The apparatus in accordance with the invention is thus seen to be highly compact, can be constructed at very reasonable cost and can therefore find justified use also for relatively lowoutputs.

The construction described is illustrative and not limiting, and variants and modifications of it that fall within the scope of protection of the invention can be freely made to it. For example instead of a manual basket, provision can be made for an automated conveyance system that conveys through the heat-shrinking chamber the package sealed by the sealing device and expels it when heat-shrinkage has taken place. In addition, the heat-shrinking can also be performed without the aid of forced air circulation, and in such case the fan would be omitted.

Noteworthy, lastly, is the fact that the basket can be interchangeable with one of different configuration, in relation to the article to be packaged. For such purpose the wall 32 will also be interchangeable with onother having an opening shaped to match the shape of the basket.

I claim:

1. A compact machine for packaging articles in heat-shrinkable film comprising a box-shaped housing having vertically extending side walls, a top wall and a bottom wall and defining therein a thermal shrinking chamber, a support means mounted on the top of the housing for rotatably supporting a roll of two ply heat-shrinkable film so that it can be pulled down over one side wall of the housing, a support on the outside of said one side wall of the housing for holding an article that has been inserted between the plys of the film, sealing means pivotally mounted on said one wall adjacent the support for sealing at least one edge of said film together and for separating the wrapped article from the roll of film, heating means for heating the air within said chamber, an opening located in a different side wall of the housing for access to the chamber, a door for closing the opening and means for holding the wrapped article separated from the film adapted to be inserted into and supported within the chamber and removed therefrom through said opening.

2. The machine of claim 1, wherein the film is two ply centerfolded film and the sealing means comprises a pair of electrical resistance sealing bars connected at right angles to one another and pivotally mounted at one end of the housing, one bar being located opposite the centerfold and the other perpendicular to the fold and opposite a sealed edge of the film from the preceding sealing step so that the wrapped article when it is sealed by the sealing bar is enclosed on four sides.

3. The machine of claim 1, wherein said holding means comprises a basket for holding the wrapped article having wheels and guides located in the chamber that cooperate with the wheels to support the basket in the chamber and guide it into and out of the opening.

4. The machine of claim 1 wherein said heating means comprises an electric resistance heating element and a fan for circulating the heated air within the chamber.

* * * * *